US009936728B2

(12) United States Patent
Wang et al.

(10) Patent No.: US 9,936,728 B2
(45) Date of Patent: Apr. 10, 2018

(54) METHOD AND DEVICE FOR FORMING CIGARETTE FILTER ROD

(75) Inventors: Xu Wang, Shanghai (CN); Ming Hou, Shanghai (CN); Yigang Tong, Shanghai (CN); Yong Si, Shanghai (CN)

(73) Assignees: SHANGHAI TABACCO GROUP CO., LTD., Yangpu District, Shanghai (CN); SHANGHAI PUFFMAN AUTOMATION & INSTRUMENT CO., LTD., Kangqiao Town, Pudong, Shanghai (CN)

( * ) Notice: Subject to any disclaimer, the term of this patent is extended or adjusted under 35 U.S.C. 154(b) by 567 days.

(21) Appl. No.: 14/401,205

(22) PCT Filed: Jul. 4, 2012

(86) PCT No.: PCT/CN2012/078160
§ 371 (c)(1),
(2), (4) Date: Dec. 25, 2014

(87) PCT Pub. No.: WO2013/170526
PCT Pub. Date: Nov. 21, 2013

(65) Prior Publication Data

US 2015/0148207 A1 May 28, 2015

(30) Foreign Application Priority Data

May 14, 2012 (CN) ..... 2012 1 0149000

(51) Int. Cl.
*A24D 3/02* (2006.01)
*A24C 5/32* (2006.01)

(52) U.S. Cl.
CPC ..... *A24D 3/0245* (2013.01); *A24D 3/0216* (2013.01); *A24D 3/0225* (2013.01); *A24C 5/322* (2013.01)

(58) Field of Classification Search
CPC .. A24D 3/0245; A24D 3/0216; A24D 3/0225; A24D 3/0287; A24C 5/322
(Continued)

(56) References Cited

U.S. PATENT DOCUMENTS 2,657,433 A * 11/1953 Merriman ..... D02J 1/18 19/0.48
3,550,508 A * 12/1970 Sprinkle ..... A24D 3/0216 131/337

(Continued)

*Primary Examiner* — Sameh Tawfik
(74) *Attorney, Agent, or Firm* — Global IP Services; Tianhua Gu

(57) ABSTRACT

A method and device for forming a cigarette filter rod. The method is as follows: in a process of continuously conveying forward cigarette filter materials that tend to converge to have a rod shape, multiple granular additives are continuously output in accordance with a certain time interval, and are sprayed into the cigarette filter materials that converge forwards under the action of continuous transporting flows, so that after the cigarette filter materials converge to form a continuous filter rod, multiple groups of additive unit combinations formed of different granular additive units are embedded in an axial direction of the filter rod. With the method and device for forming a cigarette filter rod, a filter rod containing multiple granular additives can be formed in one step; multiple granular additives can be combined and arranged in any way along an axial direction of the filter rod; dosage positions and intervals of various granular additives can be adjusted and changed randomly; a production process is simplified and the production cost is reduced.

10 Claims, 2 Drawing Sheets

(58) Field of Classification Search
USPC ..... 493/47
See application file for complete search history.

(56) References Cited

U.S. PATENT DOCUMENTS

| | | | | |
|---|---|---|---|---|
| 6,427,699 | B1 * | 8/2002 | Schlisio | A24D 3/0287<br>131/282 |
| 7,115,085 | B2 * | 10/2006 | Deal | A24D 3/0216<br>131/275 |
| 7,381,175 | B2 * | 6/2008 | Dawson | A24D 3/061<br>493/47 |
| 8,262,550 | B2 * | 9/2012 | Barnes | A24D 3/0216<br>439/4 |
| 8,303,474 | B2 * | 11/2012 | Iliev | A24D 3/0216<br>493/47 |
| 9,089,163 | B2 * | 7/2015 | Le Roux | A24D 3/02 |
| 2004/0020554 | A1 * | 2/2004 | Smith | B65B 1/366<br>141/67 |
| 2007/0284012 | A1 * | 12/2007 | Smith | A24D 3/0225<br>141/1 |
| 2009/0039102 | A1 * | 2/2009 | Garthaffner | A24D 3/0216<br>221/277 |
| 2009/0166376 | A1 * | 7/2009 | Garthaffner | A24D 3/0216<br>221/282 |
| 2015/0282522 | A1 * | 10/2015 | Eusepi | A24C 5/475<br>131/281 |

* cited by examiner

METHOD AND DEVICE FOR FORMING CIGARETTE FILTER ROD

CROSS REFERENCE TO RELATED PATENT APPLICATION

The present application is the US national stage of PCT/CN2012/078160 filed on Jul. 4, 2012, which claims the priorities of the Chinese patent applications No. 201210149000 filed on May 14, 2012, which applications are incorporated herein by reference.

BACKGROUND OF THE PRESENT INVENTION

Field of Invention

The present invention relates to the manufacturing filed of tobacco, and particularly to a forming method and a forming device for a cigarette filter.

Description of Related Arts

In order to filter some certain of hazardous substances (such as nicotine, tar) of cigarette smoke, the vast majority of current cigarettes are provided with filter rods. The filter rod is produced by a filter rod forming machine, e.g., the KDF2 filter rod forming machine produced by Hauni Company, Germany. The machine generally consists of two parts of a tow pretreatment section (AF) and a filter rod forming section (KDF), the coming cellulose acetate tows are the continuous fiber tows having been compressed and packaged, then the fiber tows is continuously fed into the machine; during the tow pretreatment process, the cellulose acetate tows are opened and expanded to a relative loose and board fiber band, which is sprayed with plasticizer later. By the filter rod forming section, the loose, glued fiber band is furled to a carton though a furled device with a taper horn mouth, and then is packed with a continuous filter rod prepared by a forming paper. Next, after being cut into particular length specifications by a rotary cutter, the formed cellulose acetate is shaped and solidified under the action of plasticizer, and becomes a stable shaped filter rod.

A key direction of the development of cigarette manufacturing process, is to study how to reduce the harm of the hazardous substances, that are generated from the lighting and smoking of a cigarette, to human body. At present, one method commonly used is that, by applying granular additives with different absorption effects and functions, such as active carbon granules, molecular sieve granules and the like, so as to improve the filtration effect of the filter rod on hazardous substances. Besides, in order to allow smokers to get a different consumer experience, the filter rod inside is usually added with microcapsule granules containing liquid perfumes of a floral perfume, peppermint and the like, so that smokers is supplied with changes of fragrance and sensory effects. Generally, a special functional filter rob with granular additives is produced by the existing device of filter rod of cellulose acetate, by adding a particular apparatus of granular additives. In the existing technology, an apparatus of granular additives is widely arranged between a tow pretreatment section and a filter rod forming section, and then the granular additives are released to continuous transporting fiber bands; after the filter rod forming part is furled, the additives is tightly wrapped and fixed therein, so that the addition of additives is achieved.

Publication Number: WO2006/059134, title: Tobacco smoke filter production, Filtrona international limited, Milton Keyence, UK, has disclosed a production method for a filter rod with granular additives, in which the granular additives is discontinuously supplied into a pneumatic injector conduit by a valve. The valve is opened and closed repeatedly, to allow the injector conduit for feedstock and spray in a pulse mode, so that the granular additives is laterally spray to a center of collected filter material conveying forward. In such production method, the granular additives are sprayed to the filter material by adopting pulse flows, while pulse flows are discontinuous, and it requires for duty time between two sprays, which makes it difficult to carry out high-speed production. The pulse flow is varied periodically with strong and weak, which will affect the stability of the shaped granular additives.

Publication Number: WO2006/067629, title: Compound filter rod making apparatus and process, Philip Morris products S.A., Neuchatel, CH, has disclosed an apparatus for continuously making compound filter rod, in which a rotary pocket wheel is adopted. The wheel is provided with a number of interval cells, and a vacuum source applying to the rotary wheel is adopted to absorb filter mediums (granular additives) from a filter medium supply to the cell. The rotary wheel rotates upwards to a transfer opening, to release vacuum; compressed air is applied to a perforated pocket "bottom" to convey the filter mediums to a shaped continuous filter rob center, to achieve the release of granular additives. The device absorbs feedstock by vacuum, thus granular additives are likely to block the vacuum system that leads to shortage of material; besides, reliability of feedstock is reduced during high-speed operation, thereby causing shortage of material. It improves the difficulty of machining when adopting matched sealing surfaces to form a pressure system, and granular additives directly touch with the sealing surfaces, which is likely to cause pressure sealing failure.

Moreover, the above two devices for forming filter rob feature a common shortcomings, that is, during the process of forming filter rob, it is generally added with just one type of granular additive, thus, the produced filter rob contains one type of granular additive as well, in such way, the function of a cigarette filter rod is limited.

SUMMARY OF THE PRESENT INVENTION

Aiming at the disadvantages of the prior art, the object of the present invention is to provide a method for forming a cigarette filter rod, which features smooth and steady conveying of feedstock, and is able to achieve in high-speed manufacture, and is able to add with multiple granular additives during the manufacture process as well.

In order to solve the above technical problems, the present invention adopts the following technical solution:

A method for forming a cigarette filter rod, during a process of continuously conveying forward cigarette filter materials that tend to furl to have a rod shape, multiple granular additives are continuously output in accordance with a certain time interval, and are sprayed into the cigarette filter materials that furl forwards under the action of continuous transporting flows, so that after the cigarette filter materials furl to form a continuous filter rod, multiple groups of additive unit combinations formed of different granular additive units are embedded in an axial direction of the filter rod, the groups of additive unit combinations are uniform, spaced distribution.

Preferably, outputted granular additives and the time interval is set by a formula of the filter rob.

Preferably, the continuous transporting flows are provided by a method, in which compressed air is continuously transferred and pressed in a pipeline.

Preferably, after continuous filter robs are cut into filter robs of particular length specifications, each filter rob of particular length specification contains a group of additive unit combinations.

The present invention further discloses a device for realizing the above method for forming a cigarette filter rod, which features the specific technical solution as follows:

A device for forming a cigarette filter rod, comprising a furled mechanism for furling filter material tows of a cigarette and a rotary cutter for cutting the filter rob, the furled mechanism is connected with a confluent main pipe of additives; one end of the confluent main pipe of additives is connected with a source of compressed air, and the other end of the confluent main pipe of additives faces against a position of the furled mechanism that locates filter material tows of a cigarette to be furled; the confluent main pipe of additives is provided with at least one confluent manifold of additives, each confluent manifold of additives is connected with a dosage allocation unit, respectively; the dosage allocation unit continuously outputs granular additives to the confluent main pipe of additives through the confluent manifold of additives in accordance with a certain time interval.

Preferably, the confluent main pipe of additives is provided with a plurality of confluent manifolds of additives.

Preferably, the dosage allocation unit comprises a feedstock baffle, an allocation ring, a discharge baffle, the feedstock baffle, the allocation ring, the discharge baffle are parallel with one another, and are arranged concentrically in sequence; the feedstock baffle is provided with a feedstock through-hole, the discharge baffle is provided with a discharge through-hole, the feedstock through-hole is connect with an air-operated feeding apparatus through a pressure feeding pipe, the discharge through-hole is connected with the confluent manifold of additives, the feedstock baffle is also provided with a nozzle being connected with a source of compressed air, and the position of the nozzle faces against the position of the discharge through-hole of the discharge baffle; the allocation ring is provided with at least one allocation through-hole of additives at the periphery; the allocation ring is connected with a synchronous driving mechanism, and the synchronous driving mechanism may rotate the allocation ring, while the allocation ring is rotated, the discharge through-hole or the feedstock through-hole enables to be communication with the allocation through-hole of additives of the allocation ring.

Preferably, it further comprises an angular velocity sensor for detecting an angular velocity of the rotary cutter, and a velocity sensor for detecting a moving velocity of the shaped continuous filter rob; the angular velocity sensor, the velocity sensor are connected with a controller, and the controller is connected with the synchronous driving mechanism of each dosage allocation unit, and the controller may control the rotate speed of the allocation ring by the synchronous driving mechanism.

Preferably, there are gaps between the allocation ring of the feedstock baffle and the discharging baffle, while the width of the gaps should be less than the smallest granular diameter of the granular additives to be transferred.

Preferably, the width of the gaps is 0.01 mm-1 mm.

Preferably, the width of the gaps is 0.05 mm-0.2 mm.

Preferably, the width of the gaps is 0.1 mm.

Preferably, the determined volume by the thickness of the allocation ring and the aperture of the allocation through-hole should be equal to or slightly larger than the dosage of smallest unit volume of the granular additives to be transferred by the corresponding dosage allocation unit.

Preferably, an intersected angle between an entry center line of the confluent manifold of additives and a center line of the airflow direction of the confluent main pipe of additives is an acute angle.

Preferably, the source of compressed air, which is connected with the confluent main pipe of additives, is provided with a throttle valve.

With the method and device for forming a cigarette filter rod, a filter rod containing multiple granular additives can be formed in one step; multiple granular additives can be combined and arranged in any way along an axial direction of the filter rod; dosage positions and intervals of various granular additives can be adjusted and changed randomly; thus on the premise of unchanging the hardware equipments for production, a varied of novel filter robs with different granular additive unit combinations, and abundant types and functions may be produced in accordance of the production requirement, so that smokers are enable to acquire more consumption experience; and the production process is simplified and the production cost is reduced as well. In the meanwhile, the method and device for forming a cigarette filter rod adopt stable continuous transporting airflow to transport granular additives, which may improve the accuracy and uniformity of the feeding dosage of the granular additives, thereby improving the quality of the filter rob, and achieving in the high-speed production of filter robs, and enhancing production efficiency.

The above description is just an outline of the technical solution of the present invention. In order to more clearly understand the technical means of the present invention, and enable to implement the content of the specification, hereinafter, preferable embodiments of the present invention will be described in detailed combining with figures.

DETAILED DESCRIPTION OF THE PREFERRED EMBODIMENTS

The preferred embodiments of the present invention will be described in detailed combining with figures.

Figure 1:
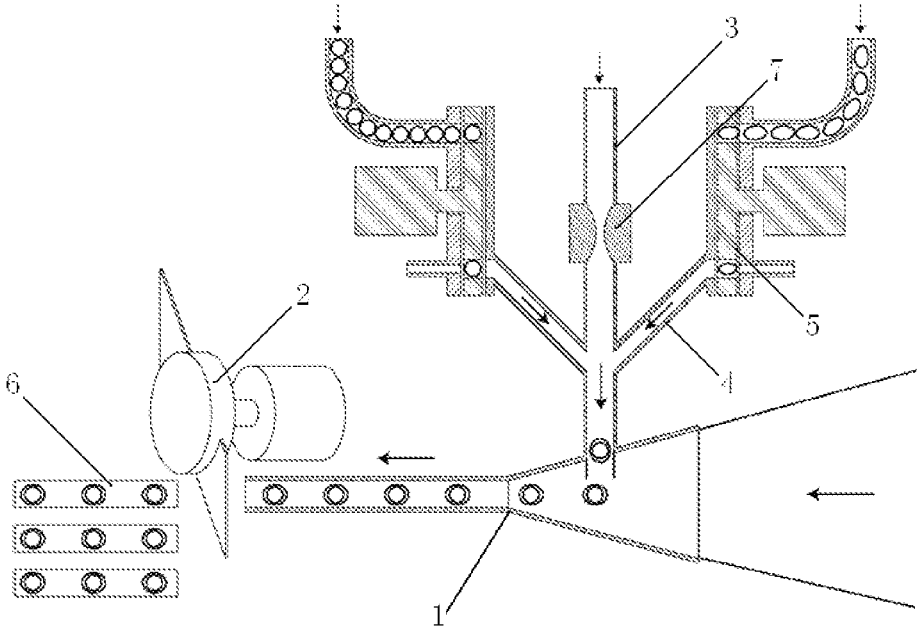
FIG. 1 is a whole structural diagram of an embodiment of the present invention.
Figure 2:
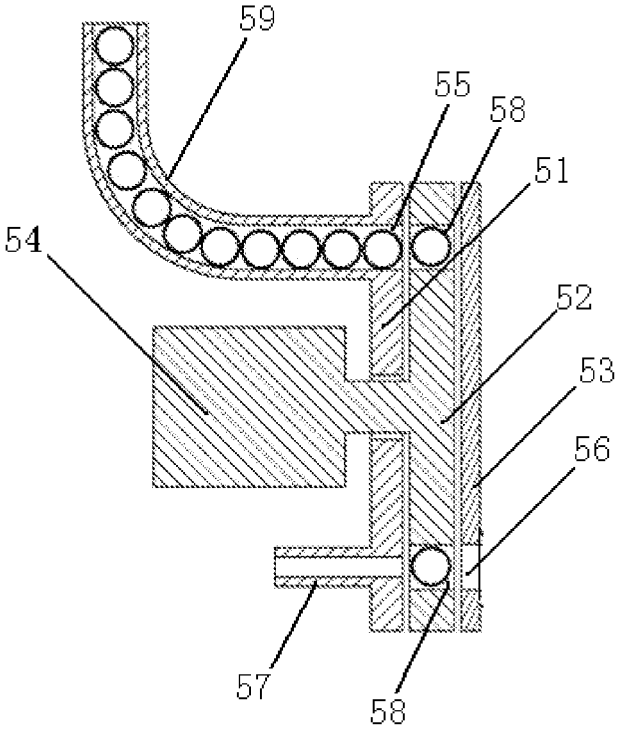
FIG. 2 is a structural diagram of a dosage allocation unit of an embodiment of the present invention.
Figure 3:
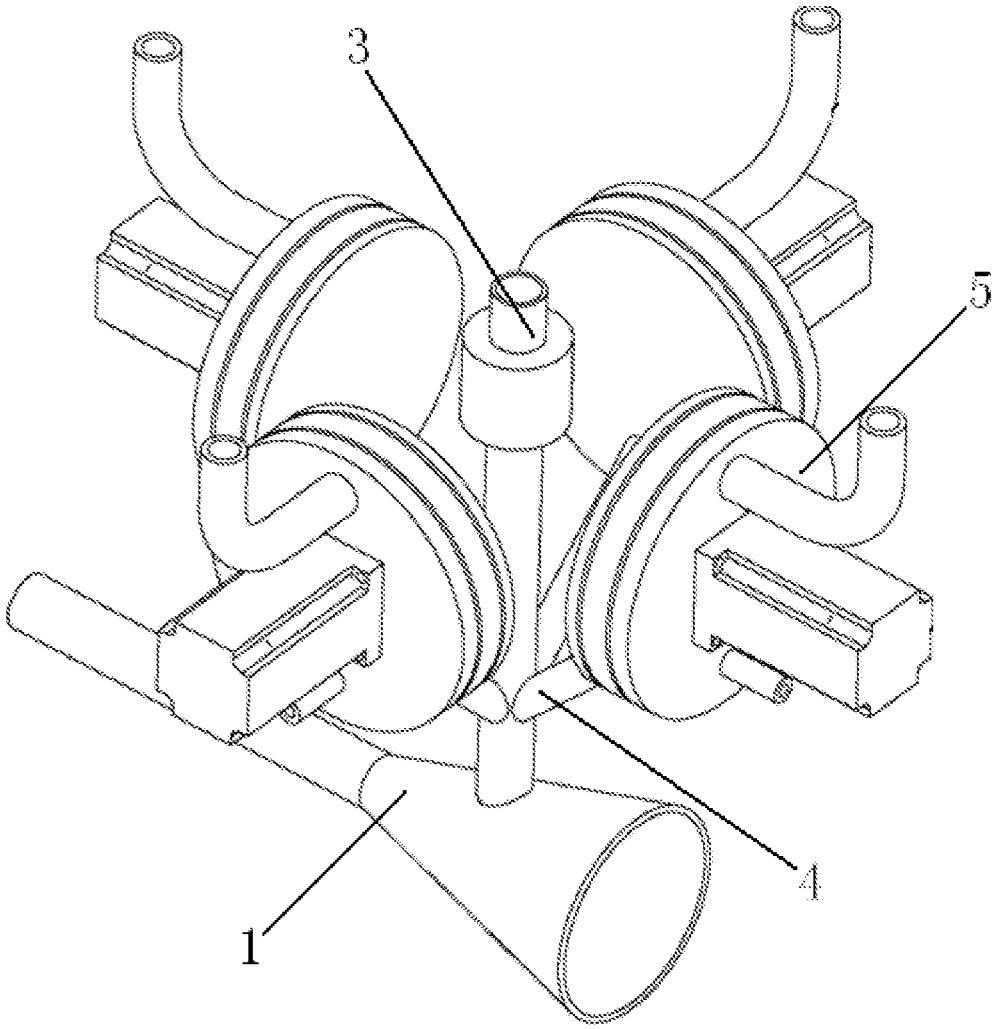
FIG. 3 is a stereo-structural diagram of an embodiment of the present invention.

As shown in FIGS. 1, 2, 3, a device for forming a cigarette filter rod, comprises a furled mechanism 1 for furling filter material tows of a cigarette and a rotary cutter 2 for cutting the filter rob. The rotary cutter 2 is arranged at one side of a discharge end of the furled mechanism 1. The furled mechanism 1 is also connected with a confluent main pipe of additives 3, one end of the confluent main pipe of additives is connected with a source of compressed air, and an opening at its other end faces against the position of the furled mechanism 1 that locates filter material tows of a cigarette to be furled. The confluent main pipe of additives 3 is provided with at least one confluent manifold of additives 4, and it is preferable to be provided with a plurality. The device for forming a cigarette filter rod as shown in FIG. 3, is provided with four confluent manifolds of additives 4; an intersected angle between an entry center line of the confluent manifold of additives 4 and a center line of the airflow direction of the confluent main pipe of additives 3 is an acute angle; each confluent manifold of additives 4 is connected with a dosage allocation unit 5.

The dosage allocation unit 5 comprises a feedstock baffle 51, an allocation ring 52, a discharge baffle 53; the allocation ring 52 is arranged between the feedstock baffle 51 and the discharge baffle 53. The feedstock baffle 51, the allocation ring 52, the discharge baffle 53 are parallel with one another, and are arranged concentrically in sequence. The feedstock baffle 51 is provided with a feedstock through-hole 55, and the feedstock through-hole 55 is connect with an air-operated feeding apparatus through a pressure feeding pipe 59; the air-operated feeding apparatus continuously outputs granular additives to the feedstock through-hole 55 by compressed air. The discharge baffle 53 is provided with a discharge through-hole 56, and the discharge through-hole 56 is connected with the confluent manifold of additives 4. The feedstock baffle 51 is also provided with a nozzle 57 being connected with a source of compressed air, and the position of the nozzle 57 faces against the position of the discharge through-hole 56 of the discharge baffle 53.

The allocation ring 52 is provided with at least one allocation through-hole of additives 58 at the periphery. The allocation ring 52 is connected with a synchronous driving mechanism 54, and the synchronous driving mechanism 54 may rotate the allocation ring 52; while the allocation ring is rotated, the discharge through-hole 56 or the feedstock through-hole 55 enables to be communication with the allocation through-hole of additives 58 of the allocation ring 52. The determined volume by the thickness of the allocation ring 52 and the aperture of the allocation through-hole 58 should be equal to or slightly larger than the dosage of smallest unit volume of the granular additives to be transferred by the corresponding dosage allocation unit. There are gaps between the allocation ring 52 of the feedstock baffle 51 and the discharging baffle 53, while the width of the gaps should be less than the smallest granular diameter of the granular additives to be transferred. The width of the gaps is generally 0.01 mm-1 mm, preferably, the width of the gaps is 0.05 mm-0.2 mm, and more preferably, the width of the gaps is 0.1 mm.

The device for forming a cigarette filter rod further comprises an angular velocity sensor arranged at the rotary cutter 2 for detecting an angular velocity of the rotary cutter, and a velocity sensor arranged at the furled mechanism 1 for detecting a moving velocity of the shaped continuous filter rob. The angular velocity sensor, the velocity sensor are connected with a controller, and the controller is connected with the synchronous driving mechanism 54 of each dosage allocation unit 5, and the controller may control the motor speed of the synchronous driving mechanism 54 to control the rotate speed of the corresponding allocation ring 52.

FIG. 2 is shown to an operation of the dosage allocation unit 5, firstly, the granular additives in the air-operated feeding apparatus enter the feedstock through-hole 55 of the feedstock baffle 51 through the pressure feeding pipe 59 under the action of air pressure, and rotate with the allocation ring 52; when the allocation through-hole 58 of the allocation ring 52 is in communication with the feedstock through-hole 55, under the action of air pressure, the granular additives in the feedstock through-hole 55 would enter the allocation through-hole 58, and the granular additives in the allocation through-hole 58 rotate with the allocation ring 52; when the allocation through-hole 58 is rotated to be in communication with the discharge through-hole 56 of the discharging baffle 53, the granular additives in the allocation through-hole 58 would be blown into the discharge through-hole 56 by the blown compressed air by the nozzle 57, and finally are outputted from the discharge through-hole 56 and entered the confluent main pipe of additives 3 through the confluent manifold of additives 4 under the action of air pressure. Form the above, the output of granular additives from the dosage allocation unit 5 is uncontinuous, and the time interval may be determined by controlling the rotate speed of the allocation ring 52.

When the device for forming a cigarette filter rod is used, firstly, the granular additive unit in a filter rod is determined in accordance with the formula requirement, i.e., which kind of granular additive unit is contained in the filter rod, as well as the combination mode, and the position relationship of various granular additive units, and the like. Next, according to the parameters such as, angular velocity of rotation of the rotary cutter 2, moving speed of the shaped continuous filter rods and the like, to determine the output time interval of each kind of granular additive, and the rotate speed of a corresponding allocation ring is controlled by the controller as well. During the operation process, each dosage allocation unit 5 outputs a certain dosage of granular additives in accordance with the given time interval, and the outputted granular additives enter the confluent main pipe of additives 3 through the respective confluent manifold of additives 4 for converging. One end of the c confluent main pipe of additives 3 is connected with the source of compressed air, and the source of compressed air may supply continuous transporting airflow for the confluent main pipe of additives 3; and the various granular additives converged in the confluent main pipe of additives 3 are sprayed into the cigarette filter material in the furled mechanism 1 under the action of continuous airflow. The cigarette filter material containing the granular additives finally forms a shaped continuous filter rob by the furled mechanism 1, and those various granular additives that have been sprayed into the cigarette filter material form various granular additive units. Under the action of continuous transporting airflow, each granular additive may be sequentially sprayed into the cigarette filter material according to its own output time, as a result, its position relationship and amount in the filter rod can be controlled by controlling the output time of each kind of granular additive.

During the actual control process, a cutting period of the rotary cutter can be determined by detecting the angular velocity of the rotary cutter, and by controlling the times of connectivity between the allocation through-hole 58 of the allocation ring 52 and the discharge through-hole 56 within a cutting period, it is able to correspondingly control the mount of each granular additive unit in each filter rob. By detecting the moving velocity of the continuous shaped filter rod and the position of the rotary cutter, and by controlling the timing of connectivity of the allocation through-hole 58 and the discharge through-hole 56, it is able to correspondingly control the distance between each granular additive unit and an end of notch of the filter rod as well as the distance between the mutual granular additive unit. The control of the above times of connectivity and timing of connectivity can be achieved by controlling the rotate speed of the allocation ring 52 by a controller.

The above granular additives may be powder-like granular additives, spherical granular additives and various kinds of liquid micro-capsules. As for the spherical granular additives and the liquid micro-capsules, the formed granular additives units in the filter rob are generally single overall structure, while as for the powder-like granular additives, the formed granular additives units in the filter rob generally become a certain area of continuous distributed powder-like granular additives, since the flow of the powder-like granular additives is relative lower at the beginning and the end of the spraying process, and yet is relative larger in the middle of the process, the formed area of the powder-like granular additives is generally spheroid shape accordingly. As for the powder-like granular additives, the source of compressed air, which is connected with the confluent main pipe of additives 3, may be provided with a throttle valve 7, through which the flow velocity of continuous transporting airflow in the confluent main pipe of additives 3 is adjusted. By adjusting the flow velocity of continuous transporting airflow, it is able to control the width of the distributed area of the powder-like granular additives. The flow velocity of transporting airflow is inversely proportional to the width of the distributed area of the powder-like granular additives, i.e., with the decrease of the velocity of transporting airflow, the width of the distributed area of the powder-like granular additives becomes large; with the increase of the velocity of transporting airflow, the width of the distributed area of the powder-like granular additives becomes small. Therefore, with regard to the formed granular additive units by powder-like granular additives, the forming device enables to change its shape as well.

The shaped continuous filter rod formed by the furled mechanism 1 contains multiple groups of additive unit combinations, and the additive unit combinations should be uniform, spaced distribution. After the shaped continuous filter rod is cut into segmented filter rods of particular length specification, each segmented filter rod should contain a group of additive unit combinations, which is formed by a varied of granular additive units. The type, arrangement mode, position relationship of the varied of granular additive units are determined by the formula of the filter rob to be produced.

As shown in the filter rod in FIG. 1, the additive unit combinations in filter rob 6 comprise three groups of powder-like granular additive units and spherical granular additive units that are uniform, spaced distribution, and the spherical granular additive unit is wrapped within the powder-like granular additive unit. During the production process, as long as the output time and time interval of the powder-like granular additive units and spherical granular additive units (i.e., the rotation speed of the allocation ring 52 in the corresponding dosage allocation unit 5) is controlled, it is able to wrap the spherical granular additive unit within the powder-like granular additive unit.

From the above, with the method and device for forming a cigarette filter rod, a filter rod containing multiple granular additives can be formed in one step; multiple granular additives can be combined and arranged in any way along an axial direction of the filter rod; dosage positions and intervals of various granular additives can be adjusted and changed randomly; thus on the premise of unchanging the hardware equipments for production, a varied of novel filter robs with different granular additive unit combinations, and abundant types and functions may be produced in accordance of the production requirement, so that smokers are enable to acquire more consumption experience; and the production process is simplified and the production cost is reduced as well. In the meanwhile, the method and device for forming a cigarette filter rod adopt stable continuous transporting airflow to transport granular additives, which may improve the accuracy and uniformity of the feeding dosage of the granular additives, thereby improving the quality of the filter rob, and achieving in the high-speed production of filter robs, and enhancing production efficiency.

The above describes a method and device for forming a cigarette filter rod provided by the embodiment of the present invention in detailed. Any person skilled in the art may modify the embodiment and the application scope in accordance with the thoughts of the embodiment of the present invention. To sum up, the content in the specification shall not be understood to limit the present invention, and all modifications accomplished from design thoughts of the invention shall still be covered by the protection scope of the present invention.

What is claimed is:

1. A device for forming a cigarette filter rod, comprising a furled mechanism for furling filter material tows of a cigarette and a rotary cutter for cutting the filter rob, characterized in that:

a confluent main pipe of additives, one end of the confluent main pipe of additives is connected with a source of compressed air, and the other end of the confluent main pipe of additives faces is against a position of the furled mechanism that locates filter material tows of a cigarette to be furled;

at least one confluent manifold of additives is provided with the confluent main pipe of additives, each confluent manifold of additives is connected with a dosage allocation unit, respectively;

the dosage allocation unit continuously outputs granular additives to the confluent main pipe of additives through the confluent manifold of additives in accordance with a certain time interval;

the dosage allocation unit comprises a feedstock baffle, an allocation ring, a discharge baffle, the feedstock baffle, the allocation ring, the discharge baffle are parallel with one another, and are arranged concentrically in sequence; the feedstock baffle is provided with a feedstock through-hole, the discharge baffle is provided with a discharge through-hole, the feedstock through-hole is connect with an air-operated feeding apparatus through a pressure feeding pipe, the discharge through-hole is connected with the confluent manifold of additives, the feedstock baffle is also provided with a nozzle being connected with a source of compressed air, and the position of the nozzle faces against the position of the discharge through-hole of the discharge baffle; the allocation ring is provided with at least one allocation through-hole of additives at the periphery; the allocation ring is connected with a synchronous driving mechanism, and the synchronous driving mechanism may rotate the allocation ring, while the allocation ring is rotated, the discharge through-hole or the feedstock through-hole enables to be communication with the allocation through-hole of additives of the allocation ring.

2. The device for forming a cigarette filter rod according to claim 1, characterized in that: the confluent main pipe of additives is provided with a plurality of confluent manifolds of additives.

3. The device for forming a cigarette filter rod according to claim 1, characterized in that: it further comprises an angular velocity sensor for detecting an angular velocity of the rotary cutter, and a velocity sensor for detecting a moving velocity of the shaped continuous filter rob; the angular velocity sensor, the velocity sensor are connected with a controller, and the controller is connected with the synchronous driving mechanism of each dosage allocation unit, and the controller may control the rotate speed of the allocation ring by the synchronous driving mechanism.

4. The device for forming a cigarette filter rod according to claim 1, characterized in that: there are gaps between the allocation ring of the feedstock baffle and the discharging baffle, while the width of the gaps should be less than the smallest granular diameter of the granular additives to be transferred.

5. The device for forming a cigarette filter rod according to claim 4, characterized in that: the width of the gaps is 0.01 mm-1 mm.

6. The device for forming a cigarette filter rod according to claim 5, characterized in that: the width of the gaps is 0.05 mm-0.2 mm.

7. The device for forming a cigarette filter rod according to claim 6, characterized in that: the width of the gaps is 0.1 mm.

8. The device for forming a cigarette filter rod according to claim 1, characterized in that: the determined volume by the thickness of the allocation ring and the aperture of the allocation through-hole should be equal to or slightly larger than the dosage of smallest unit volume of the granular additives to be transferred by the corresponding dosage allocation unit.

9. The device for forming a cigarette filter rod according to claim 1, characterized in that: an intersected angle between an entry center line of the confluent manifold of additives and a center line of the airflow direction of the confluent main pipe of additives is an acute angle.

10. The device for forming a cigarette filter rod according to claim 1, characterized in that: the source of compressed air, which is connected with the confluent main pipe of additives, is provided with a throttle valve.

* * * * *